US008672503B2

(12) United States Patent
Guo

(10) Patent No.: US 8,672,503 B2
(45) Date of Patent: Mar. 18, 2014

(54) LIGHTING DEVICE AND THE FIXING MECHANICS THEREOF

(75) Inventor: Huang-Chen Guo, New Taipei (TW)

(73) Assignee: UPEC Electronics Corp., Junghe (TW)

( * ) Notice: Subject to any disclaimer, the term of this patent is extended or adjusted under 35 U.S.C. 154(b) by 42 days.

(21) Appl. No.: 13/416,913

(22) Filed: Mar. 9, 2012

(65) Prior Publication Data

US 2012/0230025 A1 Sep. 13, 2012

Related U.S. Application Data

(60) Provisional application No. 61/451,552, filed on Mar. 10, 2011.

(51) Int. Cl.
*F21V 33/00* (2006.01)

(52) U.S. Cl.
USPC ..... 362/148; 362/147; 362/365

(58) Field of Classification Search
USPC ..... 362/147, 148, 150, 364, 365, 366
See application file for complete search history.

(56) References Cited

U.S. PATENT DOCUMENTS

| | | | | |
|---|---|---|---|---|
| 7,670,021 | B2 * | 3/2010 | Chou | 362/148 |
| 7,736,031 | B1 * | 6/2010 | Rashidi | 362/364 |
| 2009/0086474 | A1 * | 4/2009 | Chou | 362/230 |
| 2009/0086476 | A1 * | 4/2009 | Tickner et al. | 362/231 |
| 2010/0061108 | A1 * | 3/2010 | Zhang et al. | 362/364 |

* cited by examiner

*Primary Examiner* — Laura Tso
(74) *Attorney, Agent, or Firm* — Baker & McKenzie LLP

(57) ABSTRACT

Example embodiments relate to a lighting device comprising a shell, at least one LED positioned at the bottom of the shell, and at least one fixing mechanics. The fixing mechanics comprises a base and a fixing element. An end of the base forms a plurality of pins which is ended with a hook. The fixing element connected with the base is fixed on the bottom of the shell.

15 Claims, 23 Drawing Sheets

LIGHTING DEVICE AND THE FIXING MECHANICS THEREOF

RELATED APPLICATION

The application claims the benefit under 35 U.S.C. 119(e) of U.S. Provisional Patent Application Ser. No. 61/451,552, filed Mar. 10, 2011 and entitled "A Lighting Device and the Fixing Mechanics Thereof," which is incorporated herein by reference in its entirety.

TECHNICAL FIELD

The present disclosure relates to a lighting device and the fixing mechanism thereof, and specifically relates to a lighting device and the fixing mechanism thereof utilizing at least one LED as light source.

BACKGROUND

LED (Light Emitting Diode, LED) is of a cold light source, having the characters of power saving, lower consumption, fast initiating, mercury free and longer lifetime. After the technical breakthrough for the blue LED at the end of twentieth century, high power LEDs that emit various colors of light are gradually developed and applied in various kinds of products, such as displays, projectors, lighting device, etc. Therefore, LEDs definitely are the light source attracting most attention.

However, since the light emitted from LEDs are monochromatic, this nature limits LEDs, so other light source to replace the light source emitting light with broad band spectrum, such as white light, is still seeking. To solve this problem, it is popular to use one single LED emitting light with shorter wavelength, such as blue light or ultra-violet light, with a phosphor material positioned on the optical path of the LED to transform a part of or all of the light emitted from the LED to the light which spectrum comprises light with longer wavelength, such as green light, red light, etc. Such LED to emit white light is called white LED and it is capable to replace incandescent bulbs or tubes. However, when positioning the conventional lighting device utilizing LEDs, such lighting device is fixed by merely its protruding parts of the lamp cover wedged with the installation spot, and this may cause inconvenient assembling processes or unstable assembly. Therefore, it still needs to find out better solution to these undesired problems.

SUMMARY

Present embodiments relate generally to providing a lighting device and the fixing mechanism thereof with a hook portion or an extending portion suspending or wedged with the installation spot for facilitating assembling, when assembling the lighting device is needed.

Present embodiments also relate generally to providing a lighting device and the fixing mechanism thereof with a hook portion or an extending portion stably hanging or wedged with the installation spot to promote the stability and safety of the lighting device.

According to an example embodiment, a lighting device comprises a shell, at least one LED, and at least one fixing mechanism. The at least one LED is positioned at the bottom of the shell. The at least one fixing mechanism, positioned at the outside of the shell, comprises an assembling device and a fixing device, wherein an end of the assembling device forms a plurality of pins, an end of which forming a hook portion, and the fixing device is fixed on the bottom of the shell.

According to another example embodiment, a lighting device comprises a shell, at least one LED, and a fixing mechanism. The at least one LED, positioned at the bottom of the shell. The fixing mechanism, positioned at the outside of the shell, comprises a plurality of assembling devices and a fixing device, each of the assembling devices comprising a base portion and a hook portion, the base portion connecting to the fixing device and the hook portion, and the fixing device fixedly positioned at the bottom of the shell.

According to another example embodiment, a lighting device comprises a shell, at least one LED, and a fixing mechanism. The at least one LED is positioned at the bottom of the shell. The fixing mechanism, positioned at the outside of the shell, comprises a plurality of assembling devices and a fixing device, each of the assembling devices comprising a base portion fixedly attached to the outside of the fixing device, comprising an extending portion obliquely extending from the both sides of which, and the fixing device fixedly positioned at the bottom of the shell.

According to another example embodiment, a fixing mechanism adapted for a lighting device applying at least one LED and forming a light emitting side comprises: an assembling device, and a fixing device. An end of the assembling device forms a plurality of pins, an end of the pins forms a hook portion, another end of the assembling device forms a base portion, and a part of the pins where connecting to the base portion forms a circular twist to produce a torsion. The fixing device is fixedly positioned at a side of the lighting device where is opposite to the light emitting side.

According to another example embodiment, another end of the assembling device could form a base portion, and the pins where connects to the base portion preferably form a circular twist to produce a torsion. The shape of the base portion is preferably L-shaped bar or a bar attached to the outside of the shell. According to another example embodiment, the base portion could be fixedly positioned on the outside of the shell via a rivet joint or a fastener to enhance the mechanical stability of the base portion if required. The LEDs in example embodiments could be chosen from the combinations of various kinds or types of LEDs, for example, those comprise at least one yellow LED, at least one red LED and at least one green LED.

Except the aforementioned elements, the lighting device in example embodiments could also optionally comprise at least one optical membrane, an electrical connector or a plurality of frames for providing additional function, such as, optical adjustment, power connection, or positioning. Preferably, the optical membrane is positioned on the shell, the electrical connector is electrically connected to the LEDs for supplying power, and a screwed connector is more preferably as the electrical connector adapted for the connector of the light bulbs.

Further, the lighting device in example embodiments could optically comprise a heat dissipating mechanism and/or an assembling mechanism, or a heat dissipating mechanism and/or an assembling mechanism which is integrated with the fixing mechanism. Taking the former for example, the heat dissipating mechanism could be positioned at the outside of the shell for heat dissipation, and preferably, adapted for the positions of the LEDs, for example, positioned at the bottom of the shell. Meanwhile, the amount or shape of fins positioned in the lighting device could be variable according requirement. The assembling mechanism could comprise an assembling portion and a positioning portion to receive the power supplying device, the connector or other electrical devices between the assembling portion and positioning portion. The shape of the positioning portion can be customized. The assembling mechanism could be fixedly connected to the heat dissipating mechanism by fasteners, which is not limited but such as screws. Similarly, the way to fix the assembling mechanism and the positions of the assembling mechanism is not limited by previous examples. Further, if taking the later for example, unlimited amount of fins could be positioned in the fixing device, the assembling portion and the positioning portion. For example, the fins could be positioned at the outside of the fixing device for providing heat dissipating path, the assembling portion is fixedly connected to the fixing device to receive the power supplying device, the connector or other electrical devices between the assembling portion and the positioning portion.

Therefore, according to aforementioned illustration, when assembling the lighting device in example embodiments, the hook portion of an end of the pins can be suspended at the installation spot to accomplish assembling processes, and the stable suspension of the hook portion could promote the stability and safety of the lighting device.

BRIEF DESCRIPTION OF THE DRAWINGS

The accompanying drawings are included to provide a further understanding of example embodiments, and are incorporated in and constitute a part of this description. The drawings illustrate example embodiments, and together with the description, serve to explain the principles of example embodiments. There is shown.

DETAILED DESCRIPTION

Figure 1:
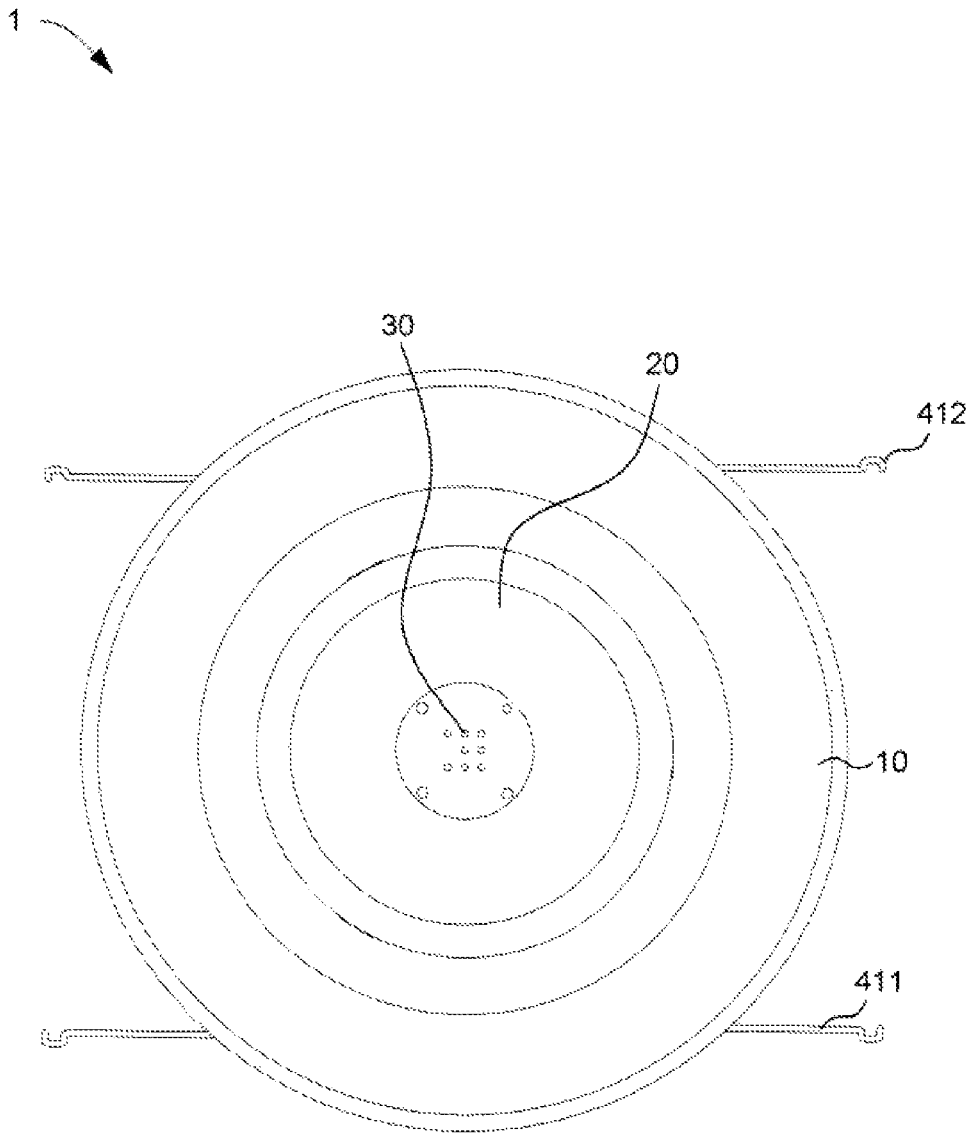
FIG. 1 shows a front view of a first example embodiment of the lighting device.
Figure 2:
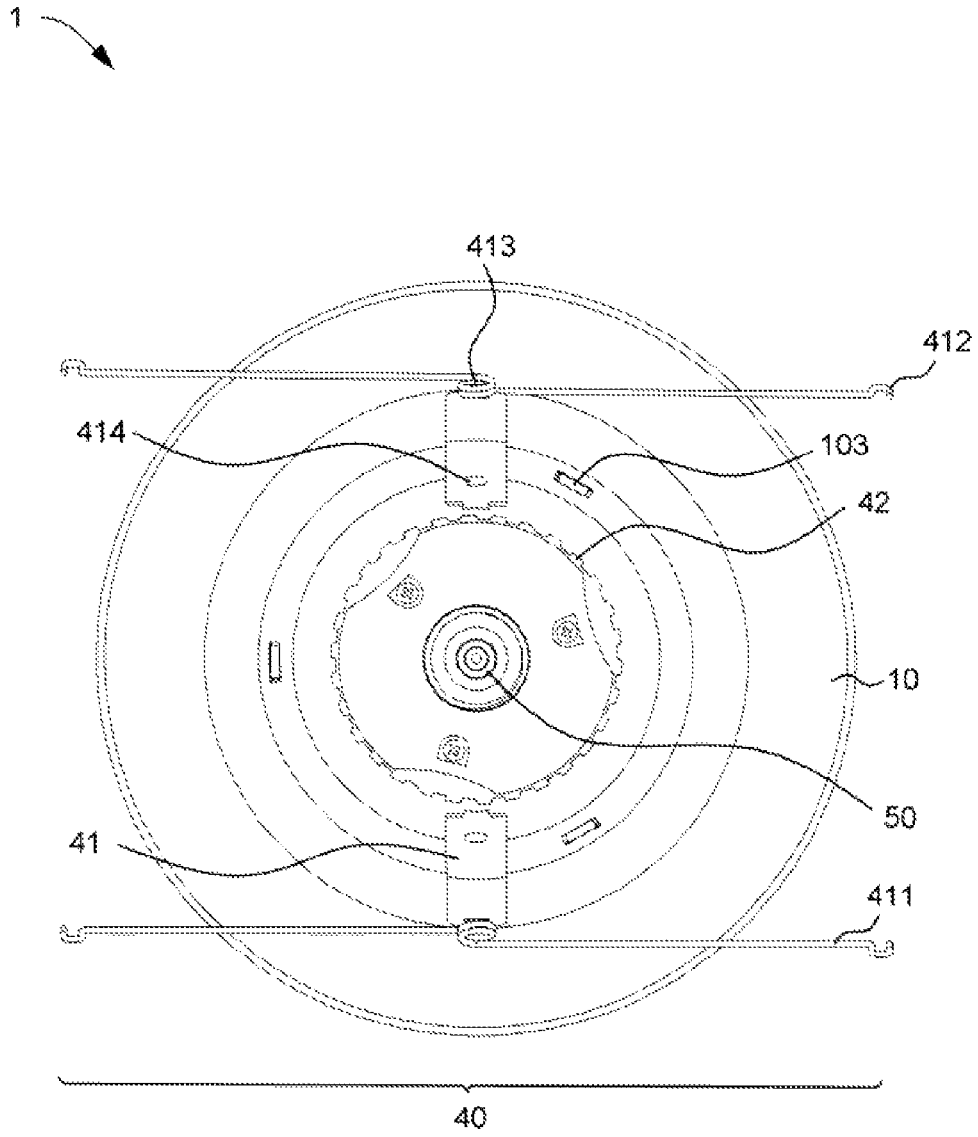
FIG. 2 shows a rear view of a first example embodiment of the lighting device.
Figure 3:
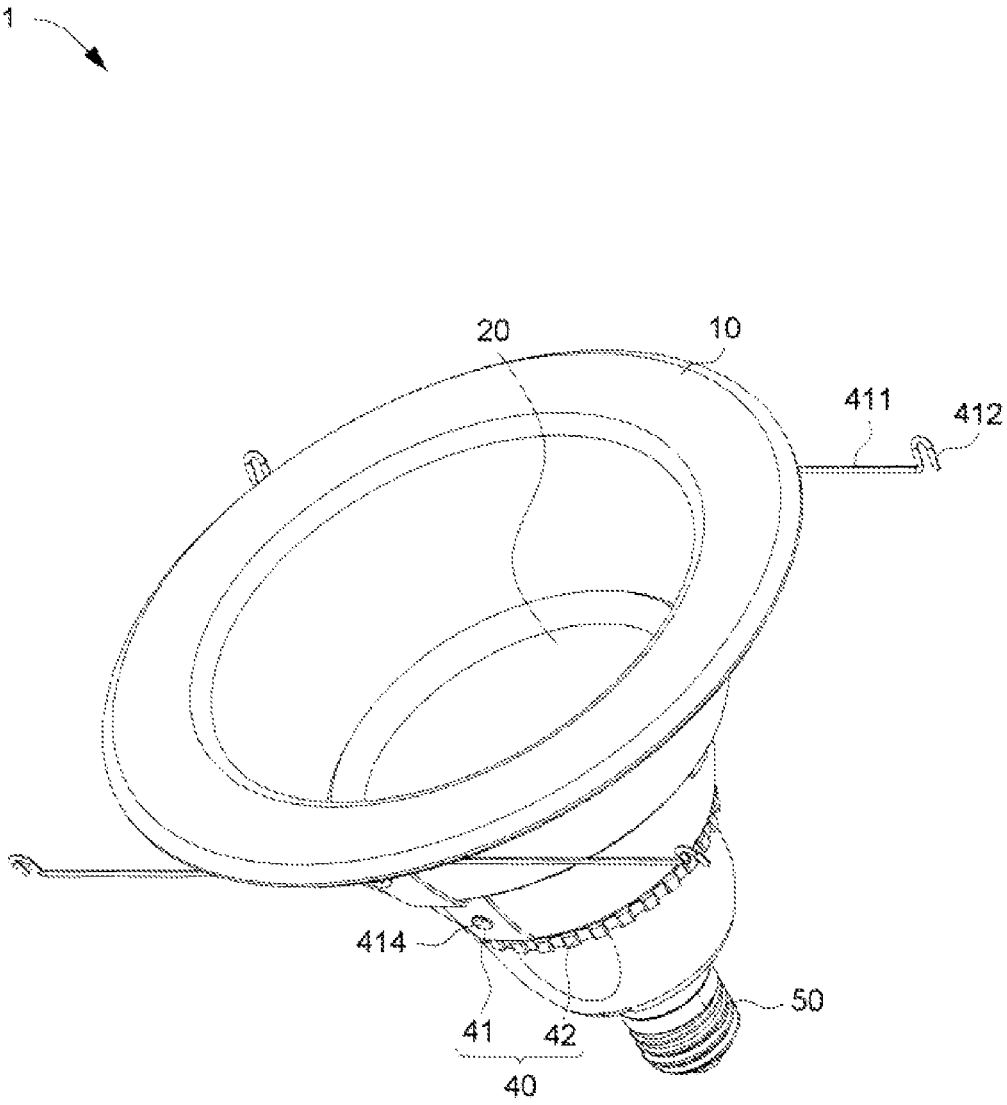
FIG. 3 shows a perspective front view of a first example embodiment of the lighting device.
Figure 4:
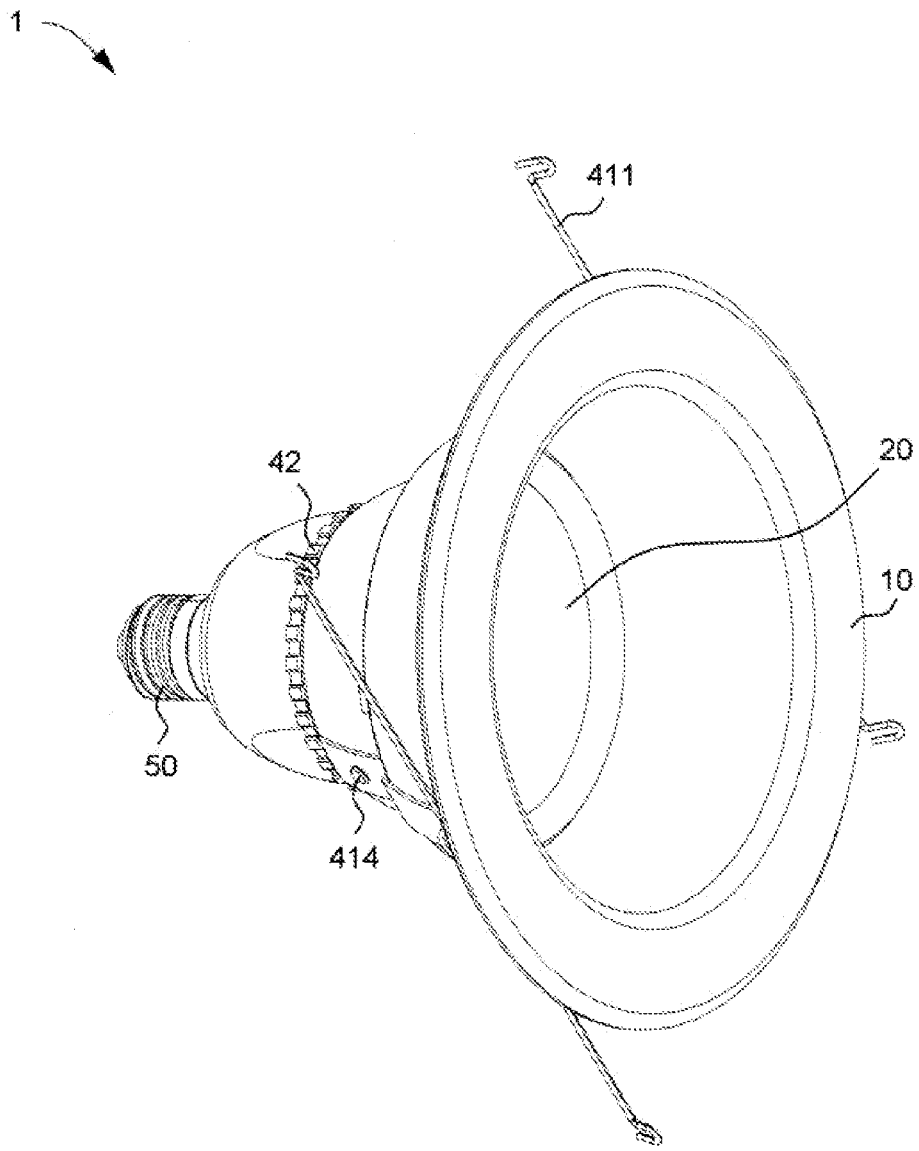
FIG. 4 shows another perspective front view of a first example embodiment of the lighting device.
Figure 5:
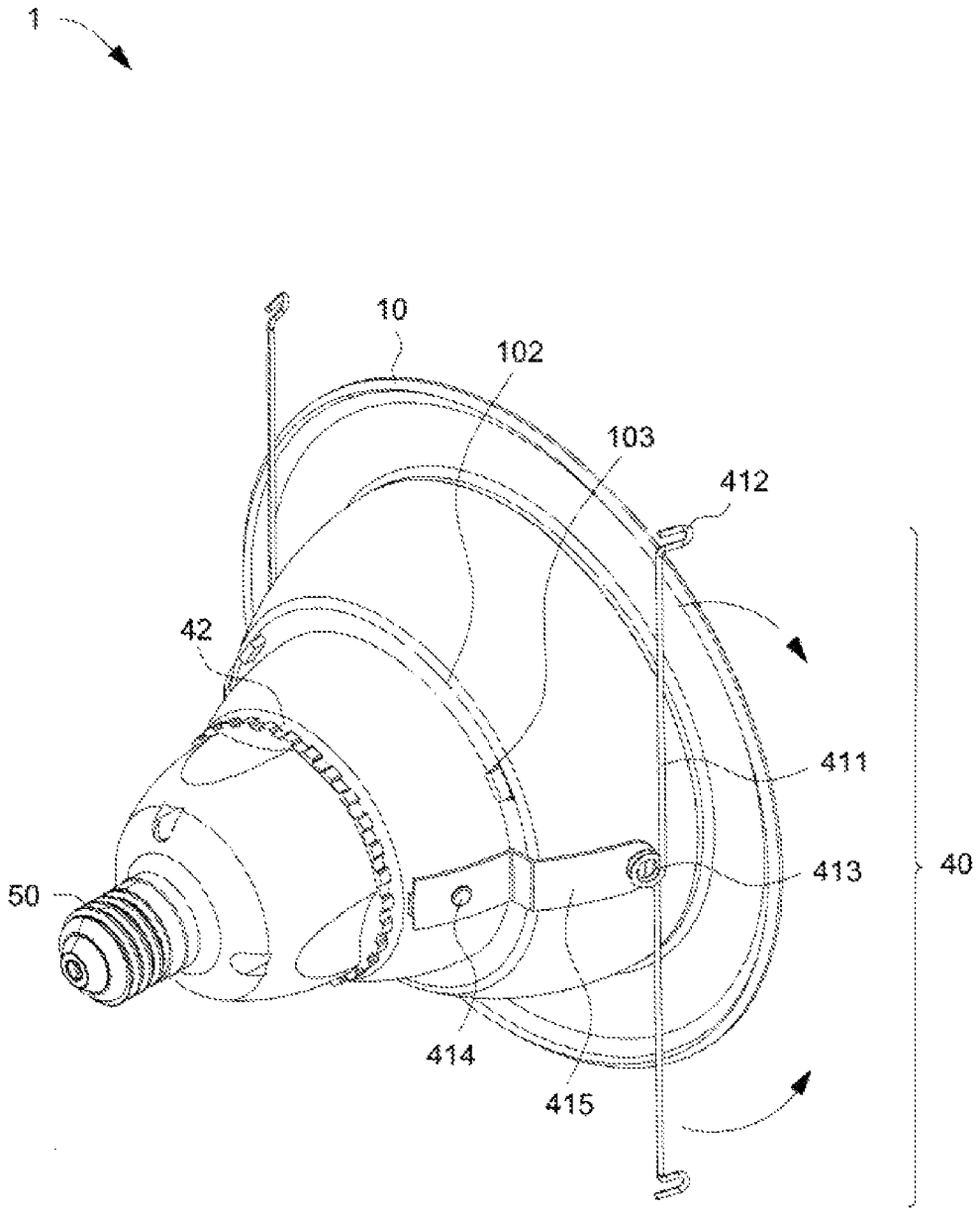
FIG. 5 shows a perspective rear view of a first example embodiment of the lighting device.
Figure 6:
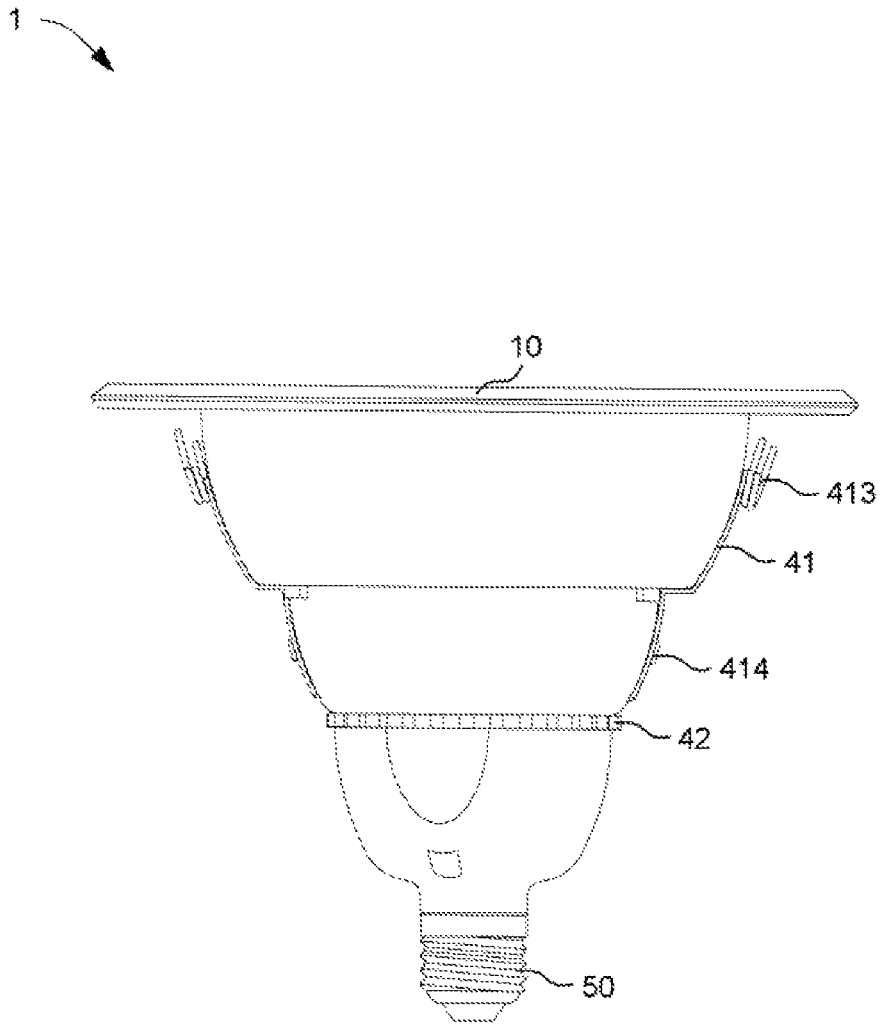
FIG. 6 shows a side view of a first example embodiment of the lighting device.
Figure 7:
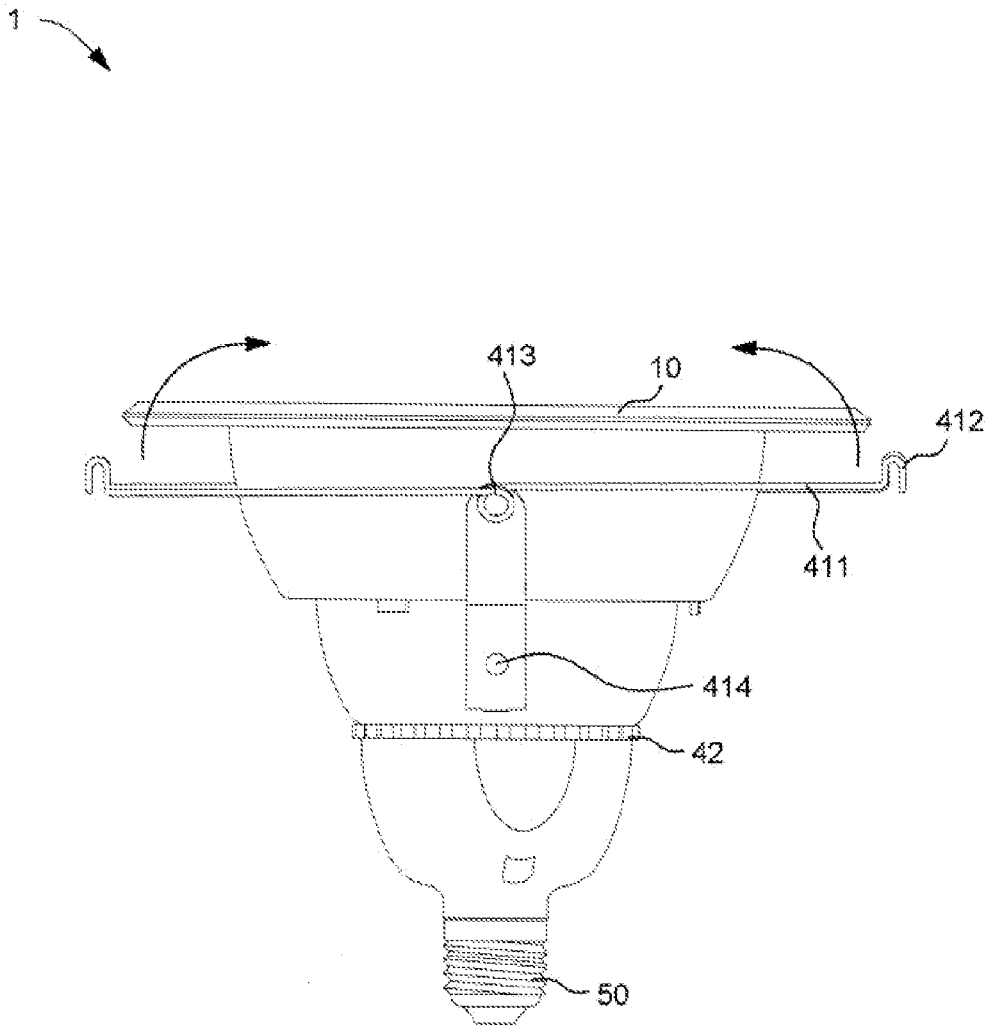
FIG. 7 shows another side view of a first example embodiment of the lighting device.
Figure 8:
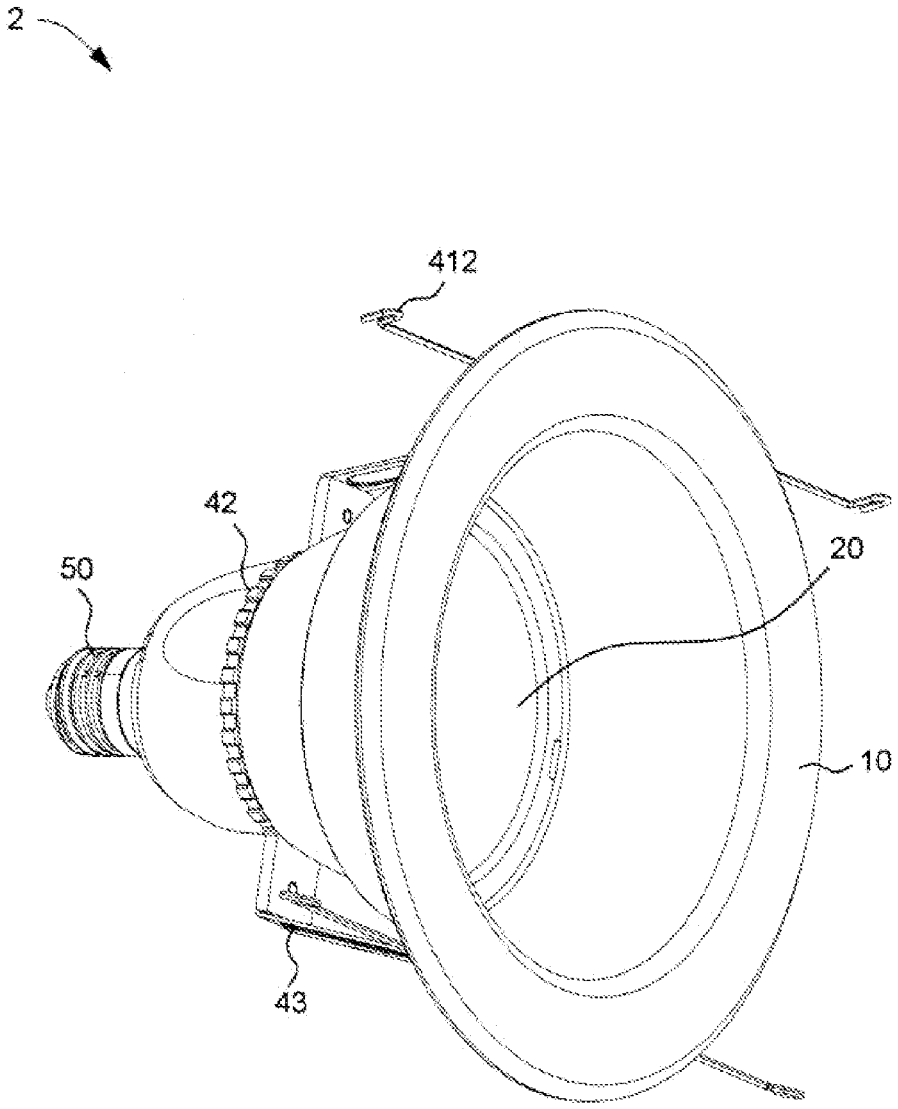
FIG. 8 shows a perspective front view of a second example embodiment of the lighting device.
Figure 9:
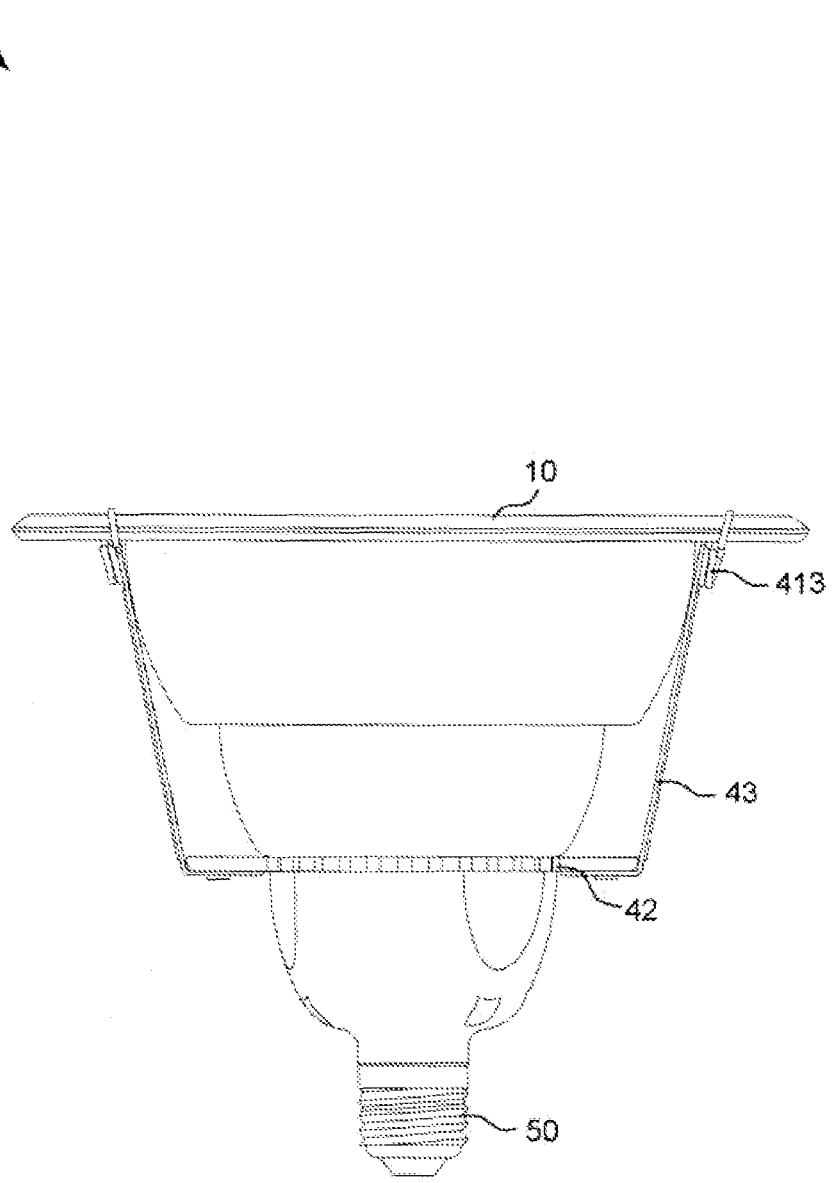
FIG. 9 shows a side view of a second example embodiment of the lighting device.
Figure 10:
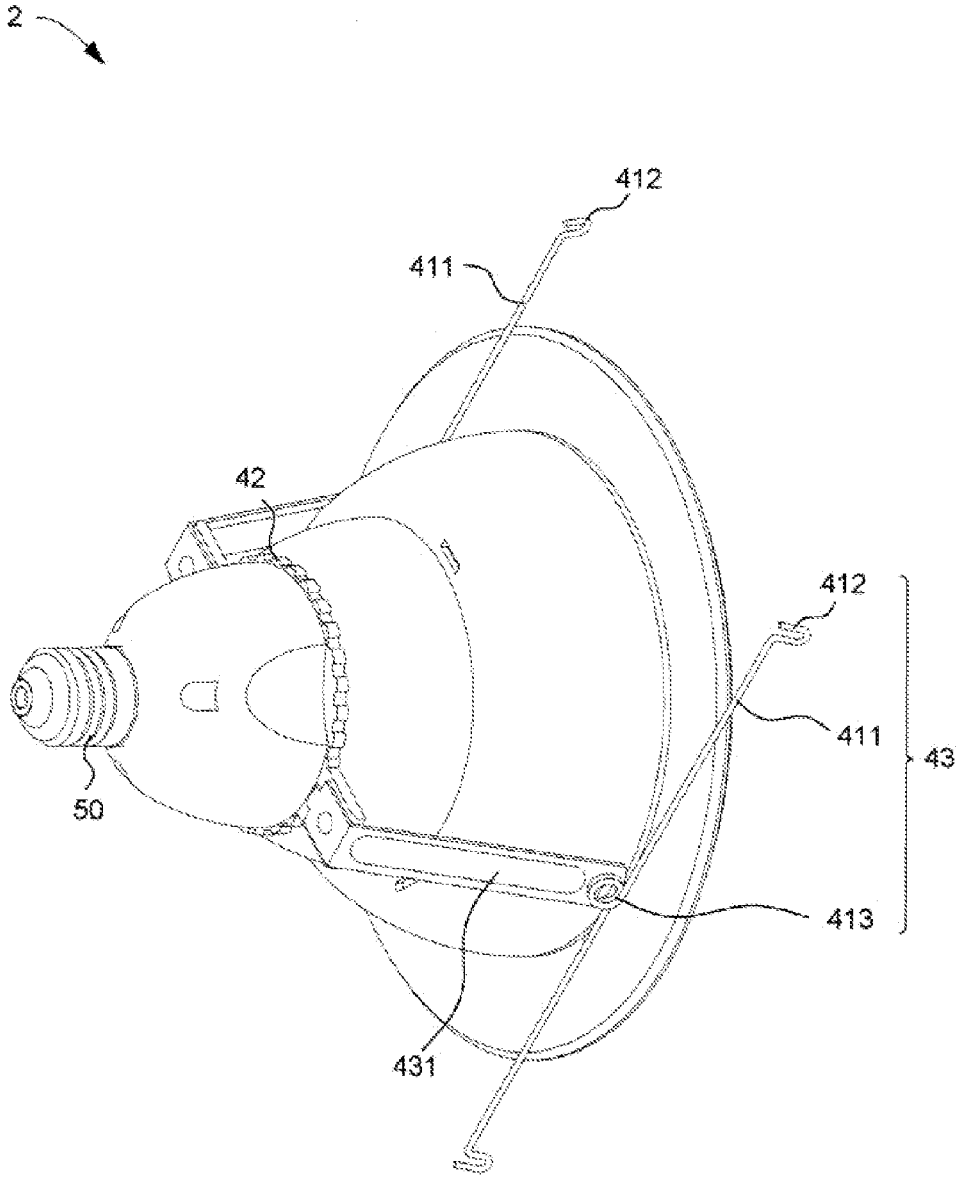
FIG. 10 shows a perspective rear view of a second example embodiment of the lighting device.
Figure 11:
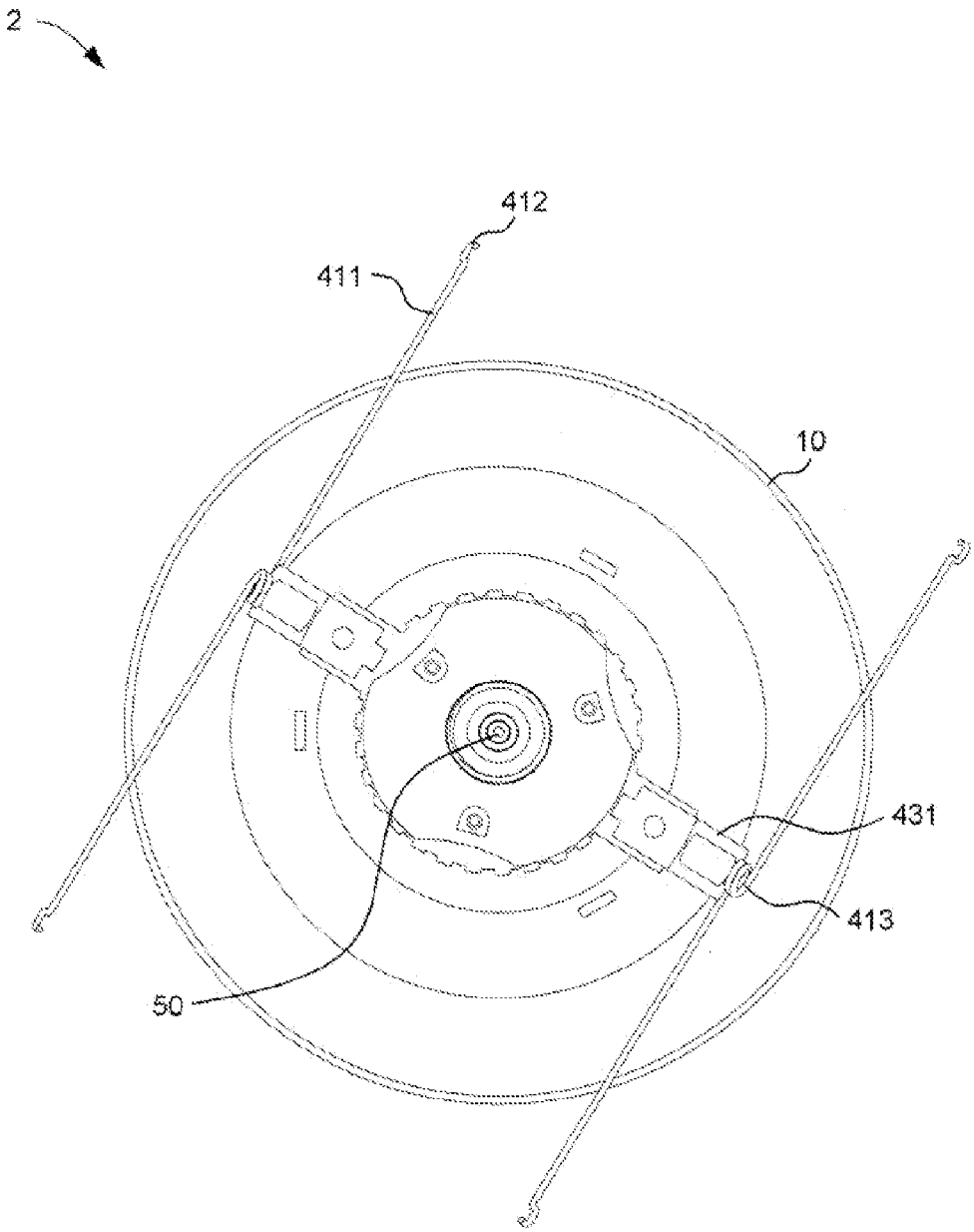
FIG. 11 shows a rear view of a second example embodiment of the lighting device.

In the following description, numerous details are set forth in order to provide a thorough understanding of example embodiments with reference to drawings which may not be drawn in an exact ratio. It will be appreciated by one skilled in the art that variations of these specific details are possible while still achieving the results of example embodiments. In other instances, well-known backgrounds are not described in detail in order not to unnecessarily obscure example embodiments.

Please refer to FIG. 1 to FIG. 7, which show perspective views of the lighting device in different view angles according to an example embodiment. As shown, the lighting device 1 comprises a shell 10, an optical membrane 20, a LED array 30, two fixing mechanisms 40 and an electrical connector 50. Here the shell 10 is not limited but preferably made by reflective material, such as metal. The shape of the shell 10 shown in the figures is only used to illustrate exemplary embodiments.

The optical membrane 20 is positioned on the shell 10, and specifically, a rib 102 is formed on the shell 10 for forming a plurality of recesses 103 or bumps, and correspondingly, a plurality of bumps 201 or recesses are formed on the optical membrane 20, therefore the optical membrane 20 could be correspondingly wedged with, fixed on or by other means to get positioned at the rib 102 of the shell 10, and preferably in the light path of the LED array 30. Therefore, the optical membrane 20 could adjust the optical character of the light emitted from the LED array 30, such as evening the intensity conformity of the light. The optical membrane 20 could be formed by various kind of membranes layered together to adjust more types of optical character.

In the present embodiment, the LED array 30 comprises a plurality of LEDs which may be chosen from different kinds or types of LEDs. For example, four yellow LEDs 301, three red LEDs 302 and one green LED 303, and all of them are positioned at the bottom 101 of the shell 10. Specifically, here the yellow LEDs 301 are positioned at the four corners of the LED array 30, and the red LEDs 302 and the green LED 303 are positioned between any two of the yellow LEDs 301. However, in other embodiments, the arrangement of the positions for these yellow LEDs 301, red LEDs 302 and green LED 303 in the LED array 30 could be various. The colorful light emitted from the yellow LEDs 301, the red LEDs 302 and the green LED 303 could naturally forms a combined light emitted from the lighting device 1 with alternately positioning the yellow LEDs 301, the red LEDs 302 and the green LED 303.

The fixing mechanisms 40 of the present embodiment positioned at the two sides of the shell 10 respectively comprise two assembling devices 41 and a fixing device 42. Here, an end of the assembling devices 41 forms a base portion 415 with the shape of a bar adapted with the outside of the shell 10 and riveting through the joint 414 or a fastener to get fixedly positioned at the outside of the shell 10 and enhance the mechanical stability of the assembling devices 41. Another end of the assembling devices 41 forms a plurality of pins 411, an end of which forms a hook portion 412, and a part of which connecting to the base portion 415 forms a circular twist 413 to generate a torsion.

The fixing device 42 of the present embodiment is fixed on the lighting device 1, where is opposite to the light emitting side. For example, at least one fastener, such as screw, can be used for stabilized positioning between the bottom 101 of the shell 10 and the electrical connector 50 to enhance the mechanical stability of the fixing mechanism 40, the shell 10, and even the whole of the lighting device 1. Therefore, when it is needed to assemble the lighting device 1, the assembling process could be accomplished by simply twisting the pins 411 along the arrows shown in FIG. 5 respectively to suspend the hook portion 412 of the shell 10 at the installation spot. The suspension between the hook portion 412 and the installation spot makes the bonding more stable than the conventional way, wedging, therefore when the lighting device 1 is vibrating, it is less likely to fall from the installation spot which may hurt people. As such, the safety is promoted.

The electrical connector 50 is electrically connected to yellow LED 301, the red LEDs 302 and the green LED 303 for providing power. The exemplary shape of the electrical connector 50 shown here is a screwed connector adapted for the connector of the light bulbs. The electrical connector 50 could optionally comprise at least one electrical device or circuit to adjust the electrical characters, such as waveform, voltage or the like, of the power source for the yellow LEDs 301, the red LEDs 302 and the green LED 303.

Please refer to FIG. 8 to FIG. 11, which show prescriptive views in different view angle of the lighting device according to a second example embodiment. Here only emphasizing the differences between the present embodiment and the first example embodiment. As shown, the shape of the assembling device 43 fixedly positioned on the base portion 431 of the shell 10 is an L-shaped bar, and the assembling devices 41 are connected to the fixing device 42.

Therefore, according to above illustration, when it is needed to assemble the lighting device of the previous embodiments, the hook portion of an end of the pins could be suspended at the installation spot for accomplishing the process, and the stable suspension between the hook portion of the end of the pins and the installation spot could promote the stability and safety of the lighting device.

Figure 12:
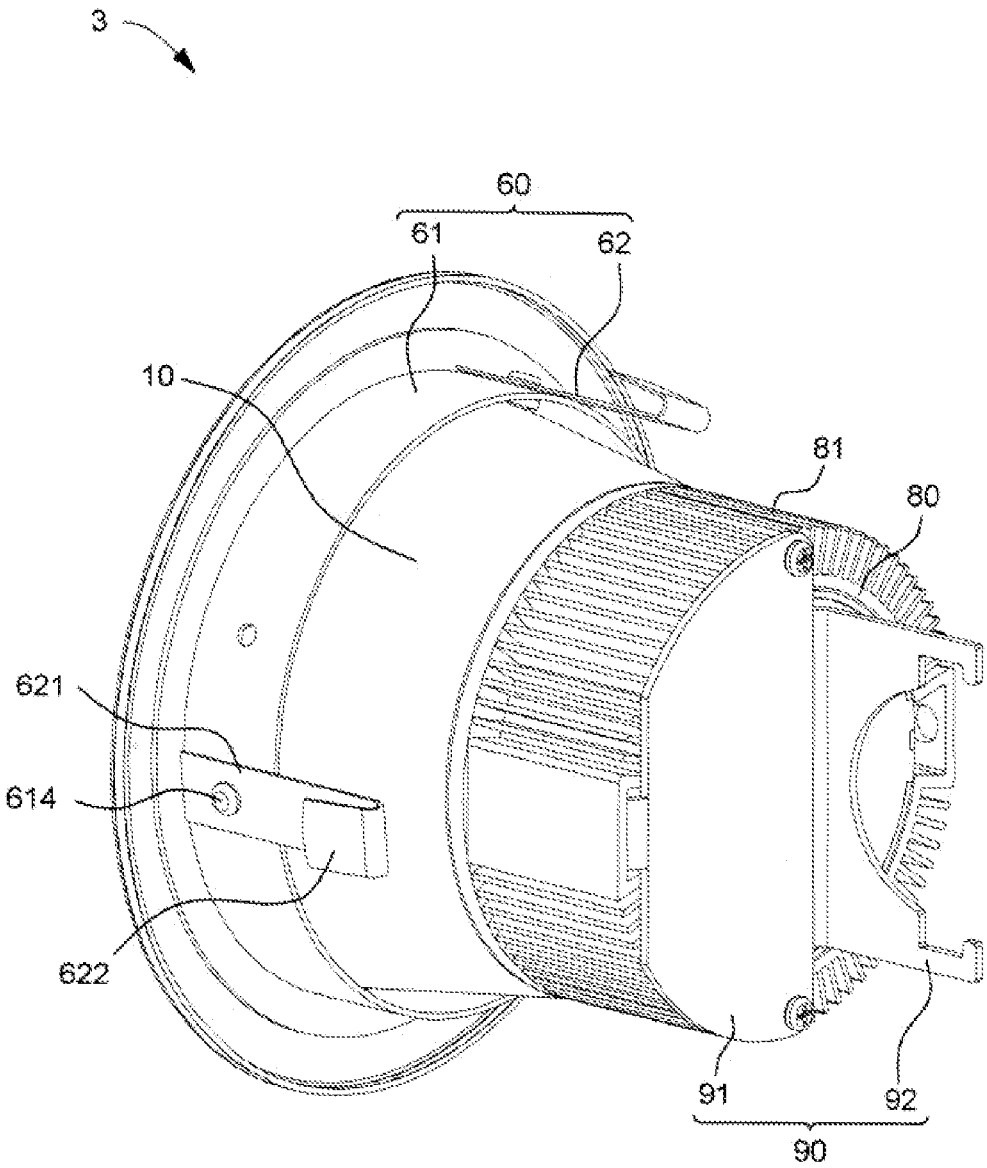
FIG. 12 shows a perspective rear view of a third example embodiment of the lighting device.
Figure 13:
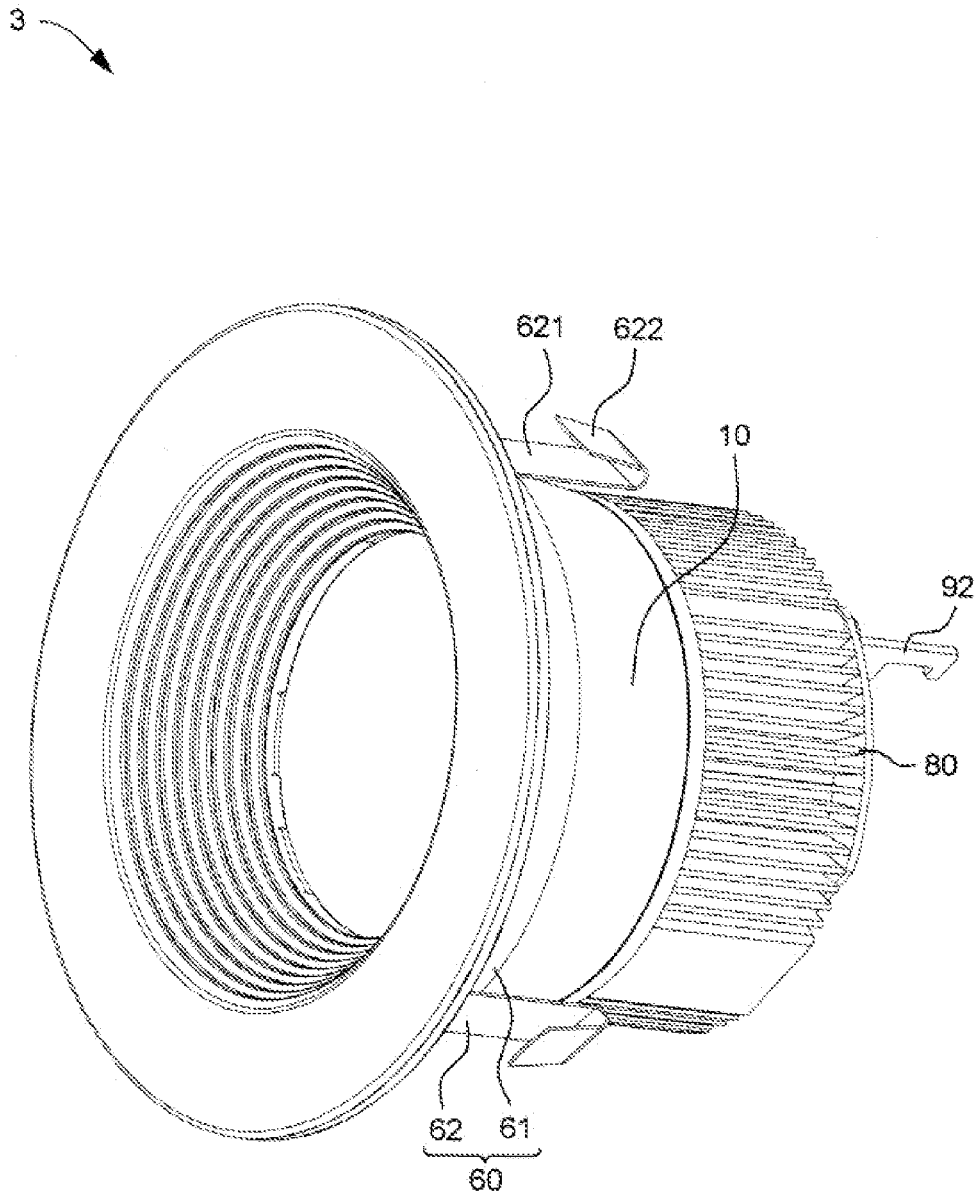
FIG. 13 shows a perspective front view of a third example embodiment of the lighting device.
Figure 14:
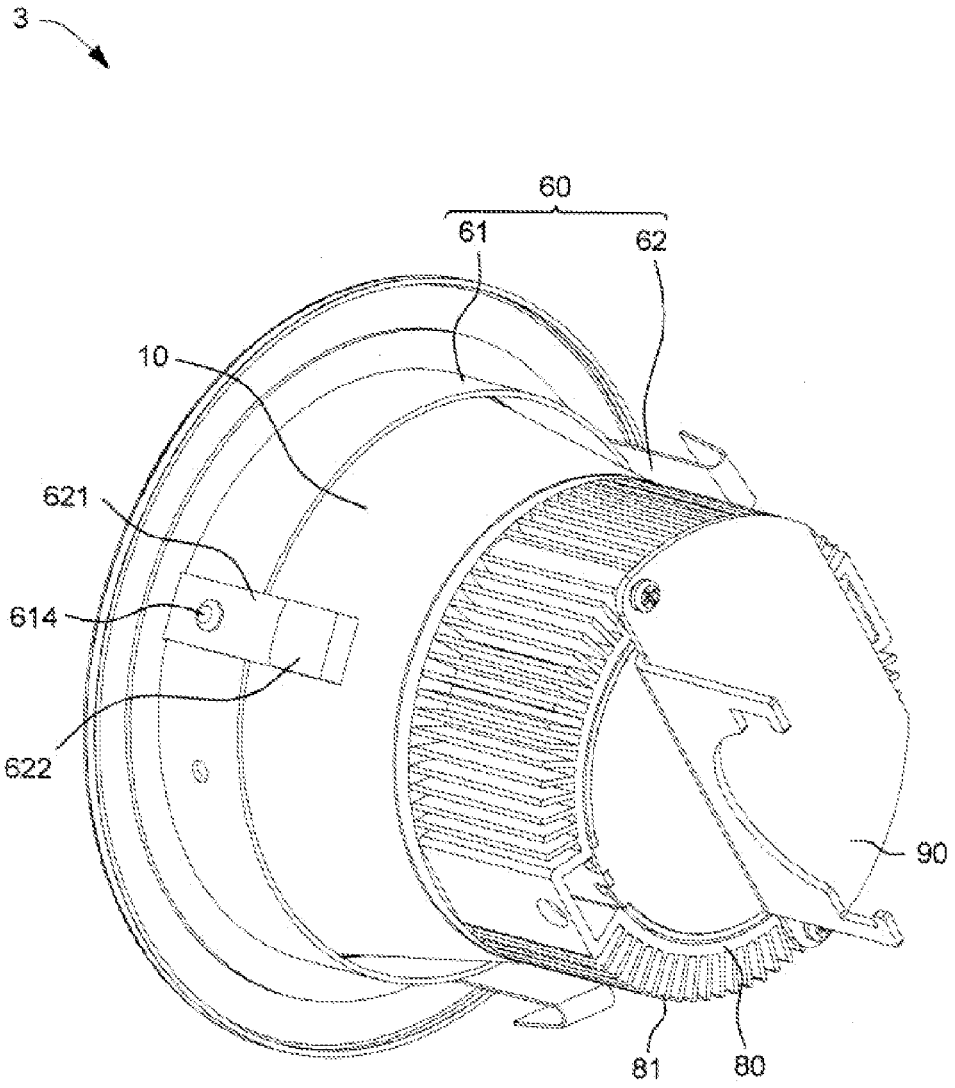
FIG. 14 shows a perspective rear view of a third example embodiment of the lighting device.

FIG. 12 to FIG. 14 shows prescriptive views of a third example embodiment of the lighting device, and the major difference between the present embodiment and the previous embodiments is the structure and positioning of the fixing mechanism. As shown in FIG. 12 to FIG. 14, the lighting device 3 comprises a shell 10, a fixing mechanism 60, a heat dissipating mechanism 80 and an assembling mechanism 90. Similar to the previous embodiments, the lighting device 3 could further comprise at least one optical membrane, at least one LED, an electrical connector and/or other elements, and please refer to the previous embodiments. The fixing mechanism 60 comprises a fixing device 61 and a plurality of assembling devices 62. In the present embodiment, the fixing device 61 is an exemplary circular frame encircling at the outside of the shell 10, and the assembling devices 62 are interposedly fixed on the fixing device 61. Each of the assembling devices 62 comprises a base portion 621 and a hook portion 622, and an end of the base portion 621 forms a hook portion 622 to allow the hook portion 622 connecting to an end of the base portion 621. Each of the base portion 621 connects to the fixing device 61 through at least one the joint 614 to get fixedly positioned at the outside of the shell 10.

The heat dissipating mechanism 80 is positioned at the outside of the shell 10 for providing heat dissipation path, and preferably, the positioning of the heat dissipating mechanism 80 is adapted to the positions of the LEDs (not shown), for example, positioned at the bottom of the shell 10. Meanwhile, any number or shape of fins 81 can be positioned in the lighting device 3.

The assembling mechanism 90 comprises an assembling portion 91 and a positioning portion 92. Here the angle between the assembling portion 91 and the positioning portion 92 is exemplary rectangle to forms a receiving space between the assembling portion 91 and the positioning portion 92 for receiving the power supplying device, connector or other electrical devices. The shape of the positioning portion 92 can be customized. Further, the assembling mechanism 90 of the present embodiment is exemplarily fixedly connected to the heat dissipating mechanism 80 through fasteners, such as screws; however, the way to position and the positions are not limited.

Therefore, in the present embodiment, through the suspension of the hook portion 622 at the end of each assembling device 62 at the installation spot, the assembling of the lighting device 3 of the present embodiment can be accomplished quickly, and the stable suspension of the hook portion 622 can promote the stability and safety of the lighting device 3. Further, because in the present embodiment the fixing mechanism 60, the heat dissipating mechanism 80, and the assembling mechanism 90*a* are all positioned at the outside of the shell 10, better heat dissipation and electrical characters could be provided.

Figure 15:
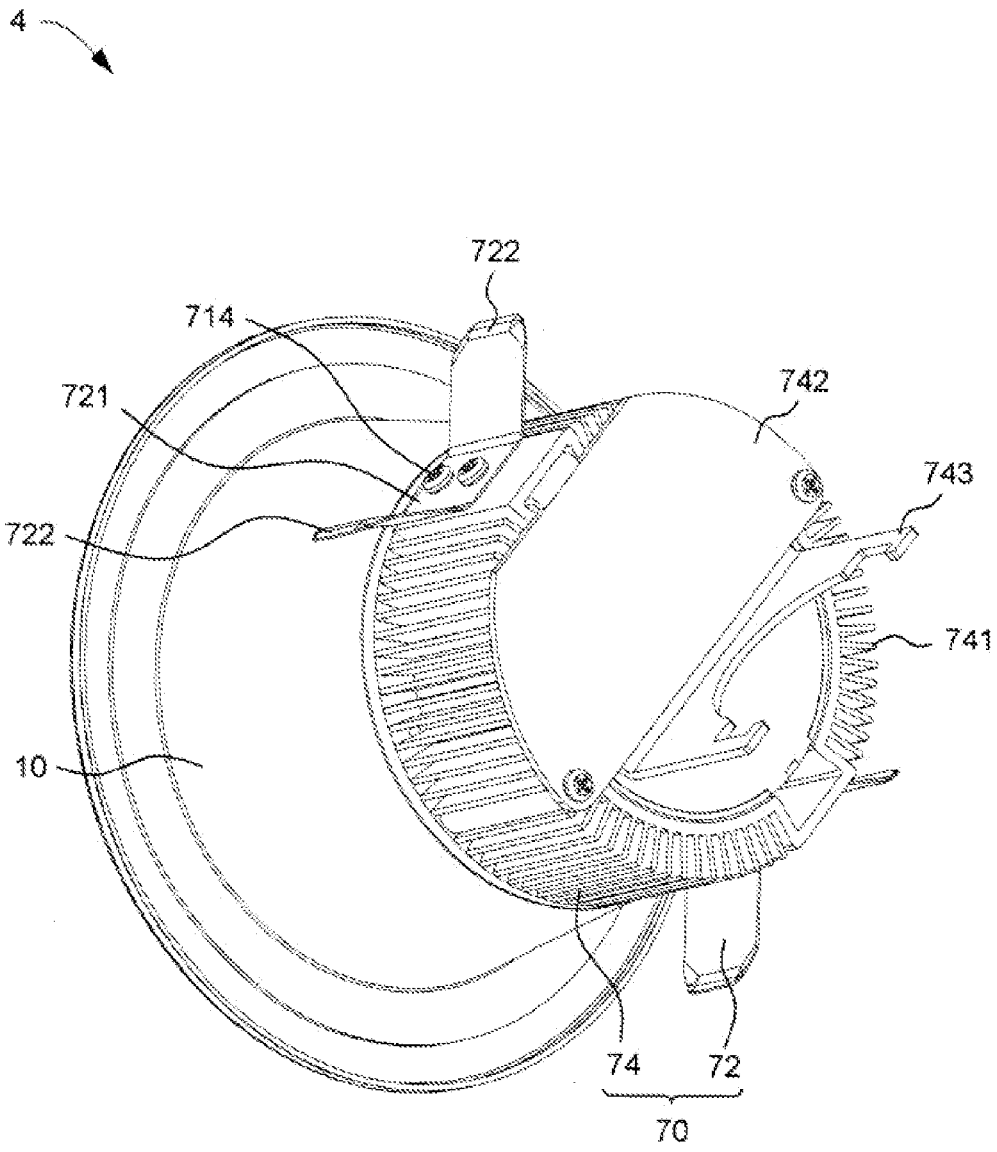
FIG. 15 shows a perspective rear view of a fourth example embodiment of the lighting device.
Figure 16:
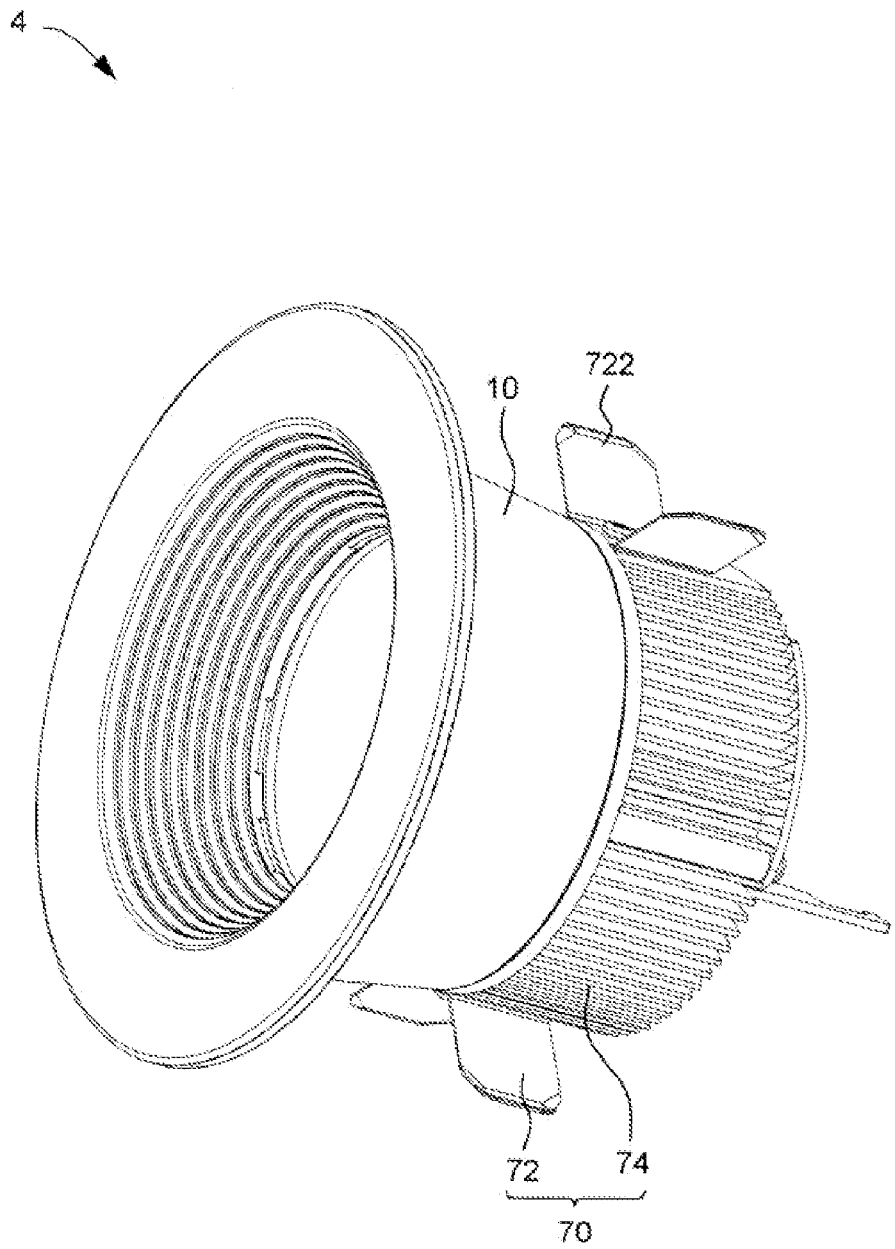
FIG. 16 shows a front view of a fourth example embodiment of the lighting device.

FIG. 15 and FIG. 16 shows prescriptive views in different view angle of the lighting device according to a fourth example embodiment, and the major difference between the present embodiment and the previous embodiments is the structure and positioning of the fixing mechanism. As shown in FIG. 15 and FIG. 16, the lighting device 4 provides a shell 10 and a fixing mechanism 70 positioned at the outside of the shell 10. Similarly, in the shell 10 there are positioned at least one optical membrane, at least one LED and/or other elements. The fixing mechanism 70 comprises several assembling devices 72 and a fixing device 74. The assembling device 72 is interposedly fixed on the outside of the fixing device 74, and each of the assembling device 72 comprises a base portion 721. Through at least one the joint 714, the base portion 721 is fixedly connected to the outside of the fixing device 74, and both of two opposite sides of the base portion 721 obliquely extend an extending portion 722 for providing stable suspension when assembling the lighting device 4. Therefore, the shape and the amount of the extending portion 722 could be customized according to the shape or the structure of the installation spot.

The fixing device 74 is fixed positioned at the bottom of the shell 10, and in the present embodiment, the fixing device 74 exemplarily comprises a plurality of fins 741, an assembling portion 742, and a positioning portion 743. The fins 741 could be positioned at the outside of the fixing device 74 for providing heat dissipation path. The assembling portion 91 is fixed connected to the fixing device 74, and here the angle between the assembling portion 742 and the positioning portion 743 is exemplary a rectangle to form a receiving space between the assembling portion 742 and the positioning portion 743 for receiving the power supplying device, the connector or other electrical devices. Therefore, the shape of the positioning portion 92 could be customized. Further, any amount or shape of fins 81 could be positioned in the lighting device 4, and they are not limited to what is shown in FIG. 15 and FIG. 16.

Figure 17:
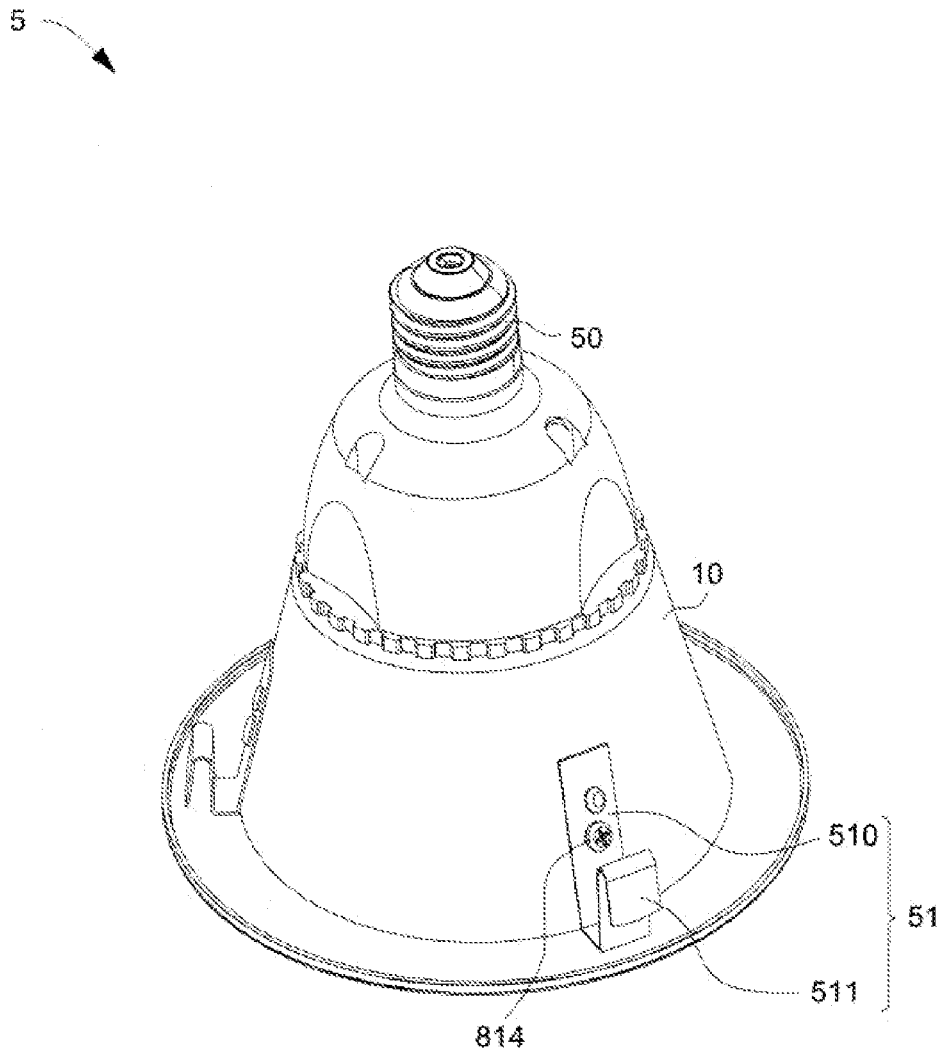
FIG. 17 shows a perspective rear view of a fifth example embodiment of the lighting device.

FIG. 17 shows a prescriptive view of the lighting device according to a fifth example embodiment, and the major difference between the present embodiment and the first embodiment is the structure and positioning of the fixing mechanism. As shown in FIG. 17, the lighting device 5 provides a shell 10 and a plurality of fixing mechanisms 51 positioned at the outside of the shell 10. Similarly, in the shell 10 at least one optical membrane, at least one LED and/or other elements could be positioned. The fixing mechanisms 51 are interposedly connected on the shell 10, and each of the fixing mechanism 51 comprises a base portion 510 and a hook portion 511. An end of the base portion 510 forms a hook portion 511 to allow the hook portion 511 connecting to an end of the base portion 510. Each of the base portion 510 connects to the shell 10 through at least one the joint 814 to get fixedly connected to the outside of the shell 10.

Figure 18:
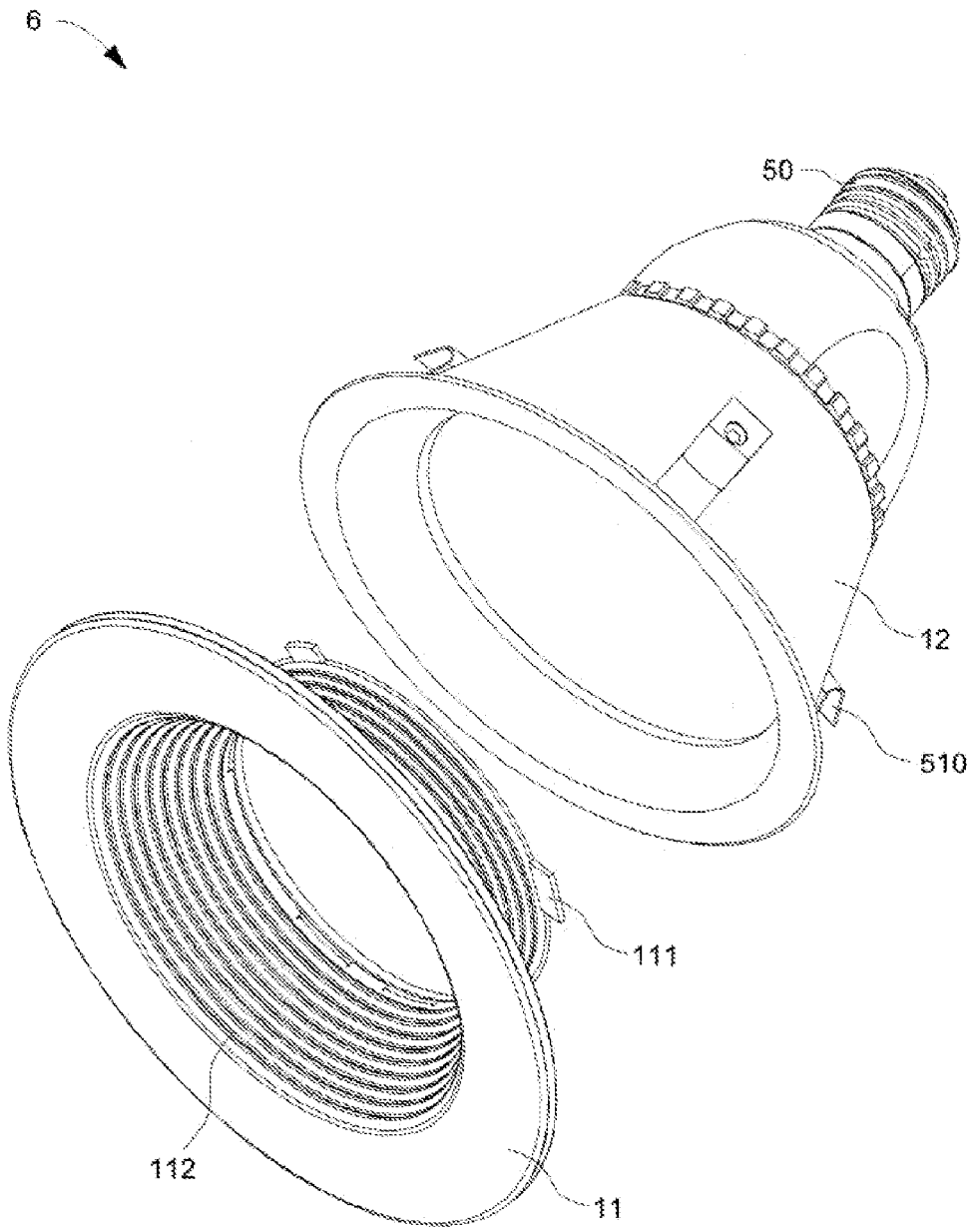
FIG. 18 shows a perspective front view of a sixth example embodiment of the lighting device.

FIG. 18 shows the prescriptive view of the lighting device according to a six example embodiment, and the major difference between the present embodiment and the fifth embodiment is the structure and positioning of the fixing mechanism. As shown in FIG. 18, the lighting device 6 provides a shell 12 and a lamp cover 11 which is fixedly connected to the bottom of the shell 12 through a plurality of bump 111. The lamp cover 11 exemplarily forms a plurality of ribs 112. Similarly, at least one optical membrane, at least one LED and/or other elements can be positioned in the shell 12.

Figure 19:
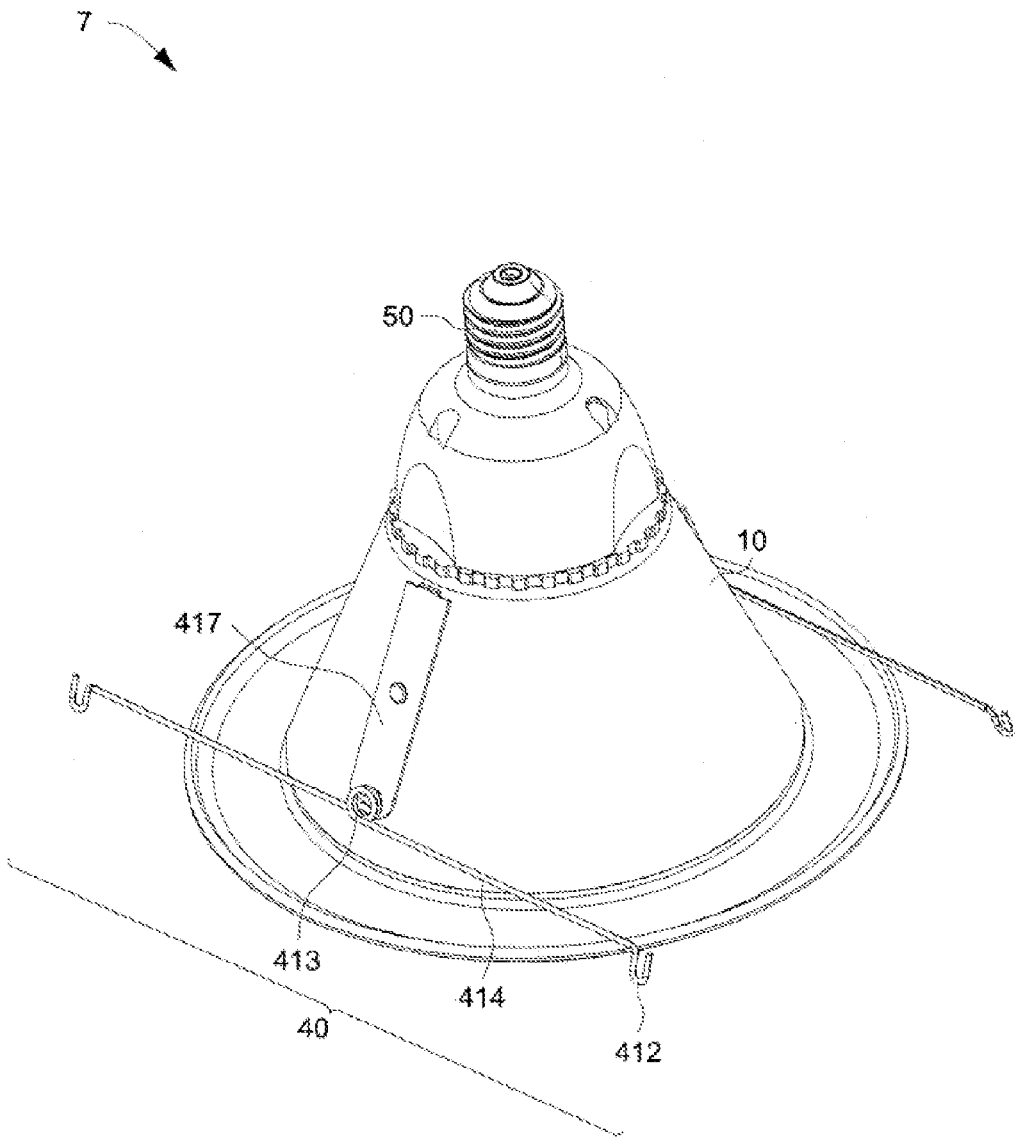
FIG. 19 shows a perspective rear view of a seventh example embodiment of the lighting device.
Figure 20:
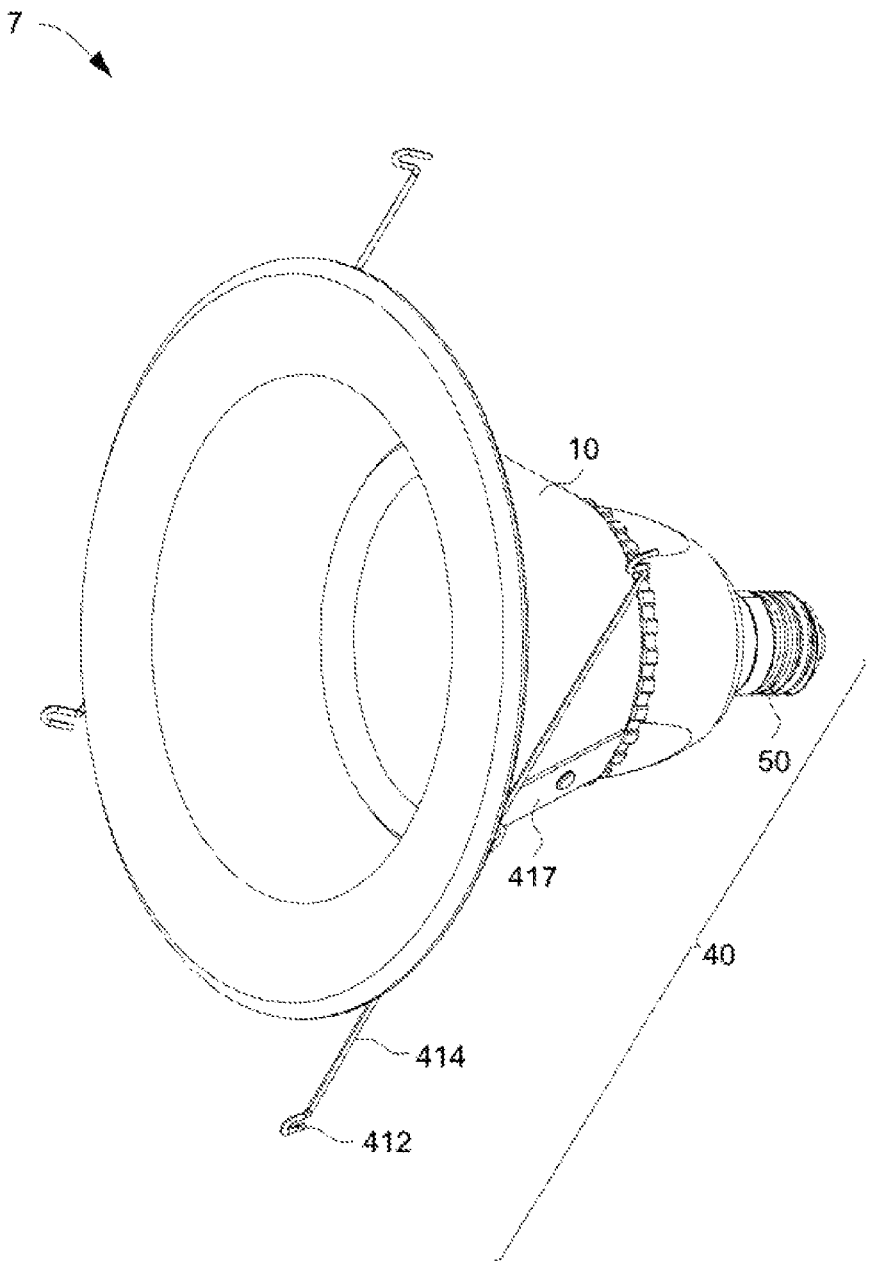
FIG. 20 shows a perspective front view of a seventh example embodiment of the lighting device.

FIG. 19 and FIG. 20 shows prescriptive views of the lighting device according to a seventh example embodiment, and the major difference between the present embodiment and the first embodiment is the structure of the shell and the fixing mechanism. As shown in FIG. 19 and FIG. 20, the lighting device 7 provides a shell 10, which side wall shows a shape of a flat surface, therefore in the present embodiment, a fixing mechanism 40 with a base portion 417 showing the similar shape of the flat surface is provided.

Figure 21:
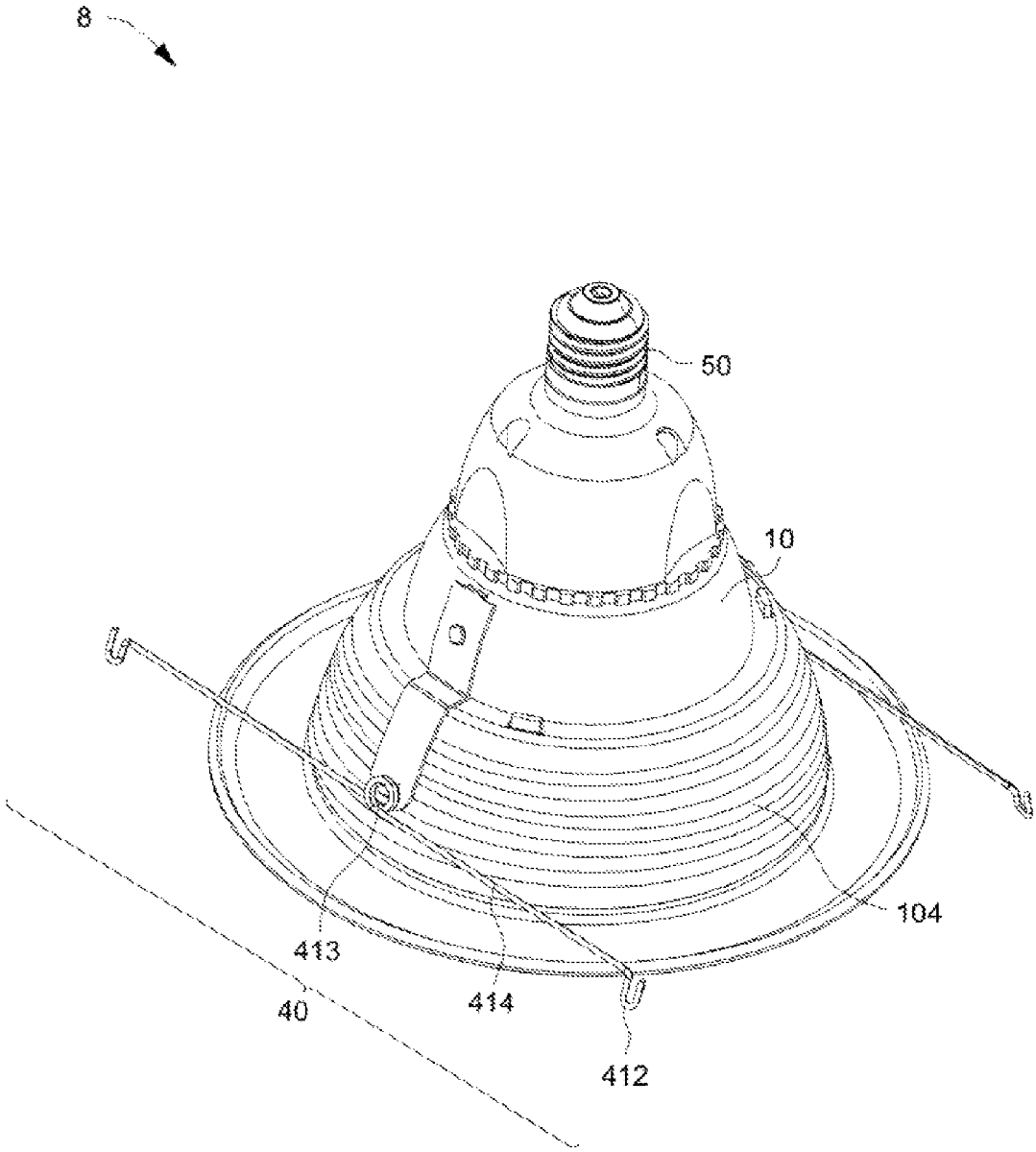
FIG. 21 shows a perspective rear view of an eighth example embodiment of the lighting device.

FIG. 21 shows a prescriptive view of the lighting device according to an eighth example embodiment, and the major difference between the present embodiment and the first embodiment is the structure of the shell. As shown in FIG. 21, the lighting device 8 provides a shell 10, which forms a plurality of ribs 104.

Figure 22:
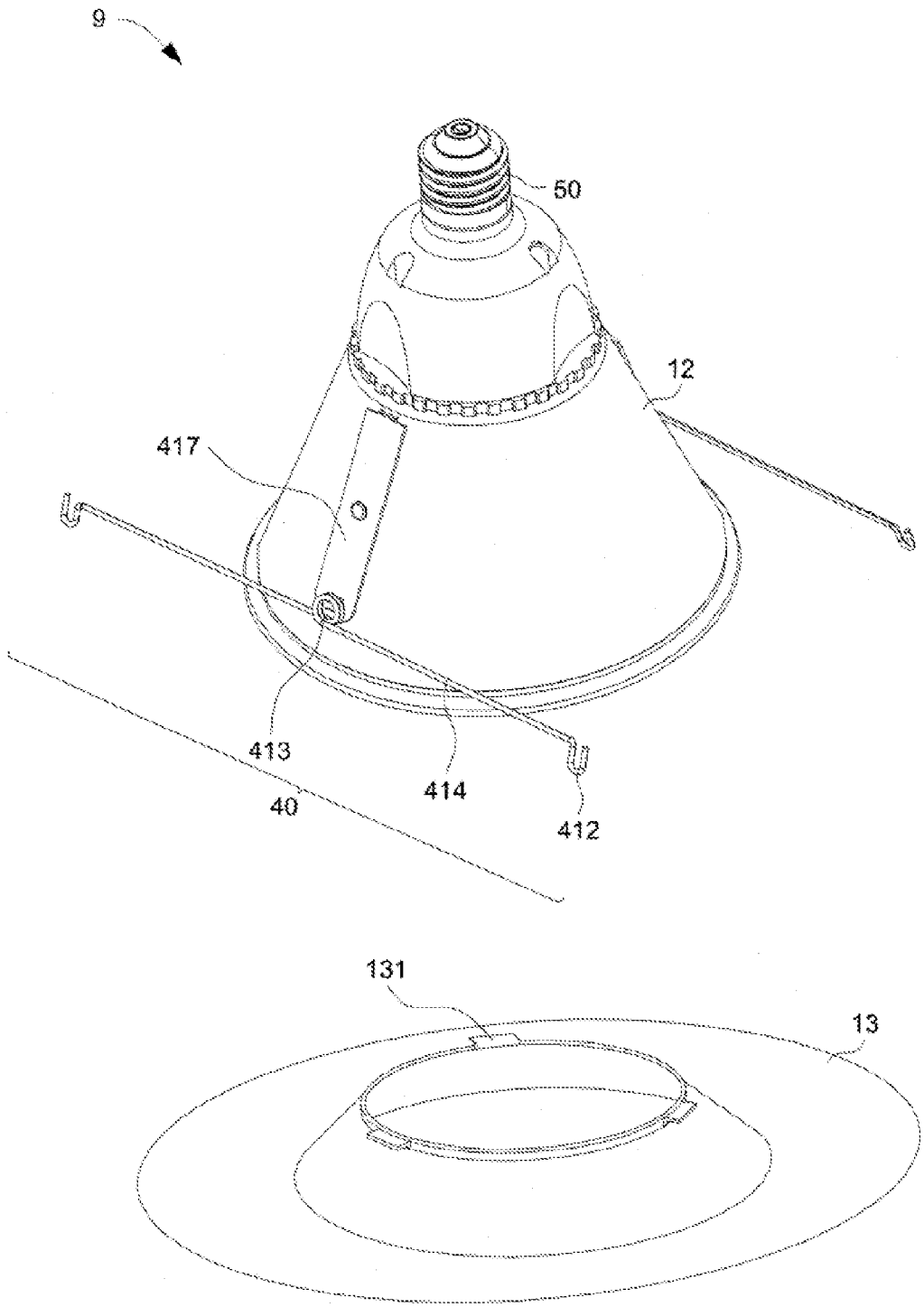
FIG. 22 shows a perspective rear view of a ninth example embodiment of the lighting device.
Figure 23:
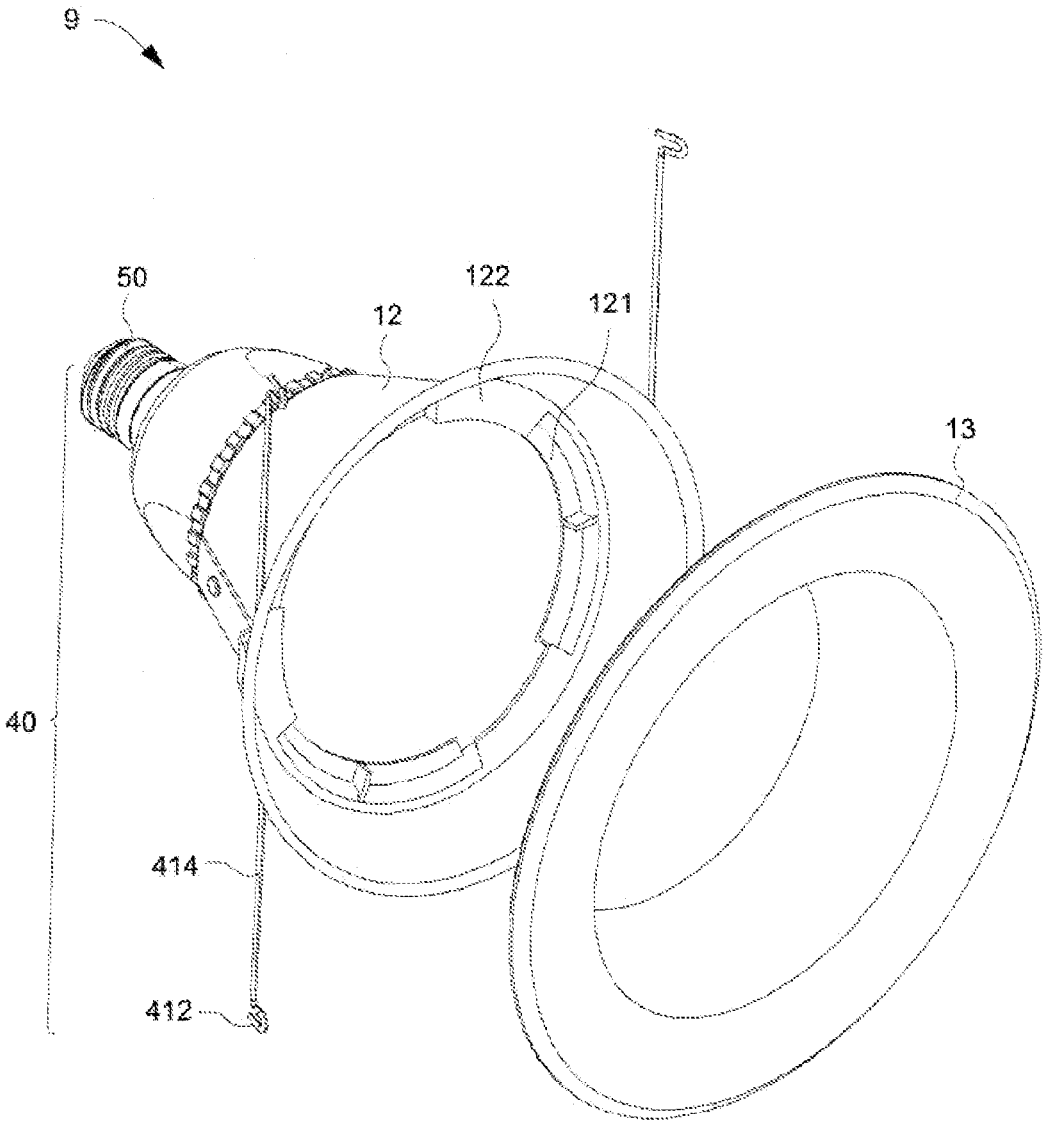
FIG. 23 shows a perspective front view of a ninth example embodiment of the lighting device.

FIG. 22 and FIG. 23 shows prescriptive views of the lighting device according to a ninth example embodiment. The major difference between the present embodiment and the seventh embodiment is the structure of the shell. As shown in FIG. 22 and FIG. 23, the lighting device 9 provides a shell 12 and a lamp cover 13 fixedly connected to the bottom of the shell 12 through a plurality of bump 131 of the lamp cover 13. Specifically, in the present embodiment, the fixedly connection between the bump 131 and the shell 12 is formed by the recess 121 and the wedged portion 122 of the shell 12, i.e., when fixedly connecting the shell 12 and the lamp cover 13, the bump 131 is correspondingly positioned in the recess 121, and the bump 131 is rotated to slide into the wedged portion 122 to get fixed; however, the way to fix the shell 12 and the lamp cover 13 is not limited to this.

Therefore, according to aforementioned illustration, when assembling the lighting device in example embodiments, the hook portion of an end of the pins can be suspended at the installation spot to accomplish assembling processes, and the stable suspension of the hook portion could promote the stability and safety of the lighting device.

Finally, those having ordinary skill in the art should appreciate that they can readily use the disclosed conception and example embodiments as a basis for designing or modifying other structures for carrying out the same purpose of example embodiments without departing from the spirit and scope claimed in the appended claims.

The invention claimed is:

1. A lighting device, comprising:

a shell;

at least one LED positioned at the bottom of the shell;

at least one fixing mechanism positioned at the outside of the shell, comprising an assembling device and a fixing device, wherein an end of the assembling device forms a plurality of pins, an end of which forming a hook portion, and the fixing device is fixed on the bottom of the shell; and an electrical connector electrically connecting to the LED;

wherein the electrical connector is a screwed connector.

2. A lighting device, comprising:

a shell;

at least one LED positioned at the bottom of the shell; and a fixing mechanism positioned at the outside of the shell, comprising a plurality of assembling devices and a fixing device, each of the assembling devices comprising a base portion and a hook portion, the base portion connecting to the fixing device and the hook portion, and the fixing device fixedly positioned at the bottom of the shell;

wherein the fixing device is a circular frame encircling at the outside of the shell.

3. A lighting device, comprising:

a shell;

at least one LED positioned at the bottom of the shell; and a fixing mechanism positioned at the outside of the shell, comprising a plurality of assembling devices and a fixing device, each of the assembling devices comprising a base portion fixedly attached to the outside of the fixing device, comprising an extending portion obliquely extending from the both sides of which, and the fixing device fixedly positioned at the bottom of the shell.

4. The lighting device of claim 3, wherein the LED comprises at least one yellow LED, at least one red LED and at least one green LED.

5. The lighting device of claim 3, further comprising at least one optical membrane positioned on the shell.

6. The lighting device of claim 3, further comprising an electrical connector electrically connecting to the LED.

7. The lighting device of claim 6, wherein the electrical connector is a screwed connector.

8. The lighting device of claim 3, further comprising a heat dissipating mechanism positioned at the outside of the shell for providing heat dissipation.

9. The lighting device of claim 8, wherein the heat dissipating mechanism comprises at least one fin.

10. The lighting device of claim 8, further comprising an assembling mechanism connecting to the heat dissipating mechanism, and the assembling mechanism comprising an assembling portion and a positioning portion.

11. The lighting device of claim 3, wherein the fixing device comprises a plurality of fins positioned at the outside of the fixing device for providing heat dissipation.

12. The lighting device of claim 3, wherein the fixing device comprises an assembling portion and a positioning portion, and between the assembling portion and the positioning portion, a received space is formed for receiving.

13. The lighting device of claim 3, further comprising a lamp cover fixedly attached to the lower part of the shell.

14. The lighting device of claim 13, wherein one of the shell and the lamp cover forms a plurality of ribs, and the lamp cover is fixed on the shell through a plurality of bumps.

15. A lighting device, comprising:

a shell;

at least one LED positioned at the bottom of the shell; and at least one fixing mechanism positioned at the outside of the shell, comprising an assembling device and a fixing device, wherein an end of the assembling device forms a plurality of pins, an end of which forming a hook portion, and the fixing device is fixed on the bottom of the shell;

wherein the fixing device comprises a plurality of fins positioned at the outside of the fixing device for providing heat dissipation.

* * * * *